United States Patent [19]

Mack

[11] 4,336,073

[45] Jun. 22, 1982

[54] GLASS CLEANING PROCESS AND APPARATUS

[76] Inventor: John H. Mack, 7208 Hitching Post La., Hyattsville, Md. 20783

[21] Appl. No.: 293,979

[22] Filed: Aug. 18, 1981

[51] Int. Cl.[3] ..... B08B 1/00; B43K 5/00

[52] U.S. Cl. ..... 134/6; 134/31; 401/203; 401/204

[58] Field of Search ..... 134/6, 31; 401/203, 401/204, 196

[56] References Cited

U.S. PATENT DOCUMENTS

| | | | |
|---|---|---|---|
| 1,358,733 | 11/1920 | Heine | 401/204 |
| 1,778,121 | 10/1930 | Paull | 401/196 |
| 1,921,921 | 8/1933 | Harvie | 401/203 |
| 2,658,218 | 11/1953 | Carreiro | 401/203 |
| 2,955,311 | 10/1960 | Jurkanis | 401/203 |
| 3,070,826 | 1/1963 | Paterno | 401/204 |
| 3,258,809 | 7/1966 | Harvey | 401/204 X |
| 4,032,239 | 6/1977 | Maupin | 401/203 |

FOREIGN PATENT DOCUMENTS

| | | | |
|---|---|---|---|
| 833653 | 4/1960 | United Kingdom | 401/203 |

*Primary Examiner*—Marc L. Caroff
*Attorney, Agent, or Firm*—John H. Mack

[57] ABSTRACT

Apparatus for cleaning glass or other nonporous surfaces having an applicator pad of open pored spongy material for juxtaposition with the surface to be cleaned. A disposable cloth or tissue is interposed between the pad and the surface to be cleaned. A flexible conduit directs moisture laden gas, usually human breath, from the user's mouth, to the applicator pad and thence to the surface to be cleaned where moisture condenses for easy removal of soil therefrom. The escape of gas in undesired directions is avoided by a hood element which confines the gas to the spongy material except where it contacts the surface to be cleaned.

5 Claims, 3 Drawing Figures

GLASS CLEANING PROCESS AND APPARATUS

This invention relates to a process and device for cleaning windows or other planar nonporous surfaces. More particularly, the device utilizes the moisture content of human breath as the cleaning agent, thus avoiding the necessity for supplying any glass cleaning liquid to the surface to be cleaned. It is, of course, known to breathe on a cool glass surface, such as eye glasses, and then wipe off the condensed moisture along with whatever contaminant may be present. The condensed moisture is pure water, and it is noted that a recent consumer product testing organization has found plain water usually adequate for cleaning windows. This invention relates to a method and apparatus for conducting the human breath, laden with moisture, in an efficient manner to the glass or other surface in the presence of an absorbent wiping material.

FIG. 1 of the drawing is an isometric view of the cleaning apparatus.

Figure 1:
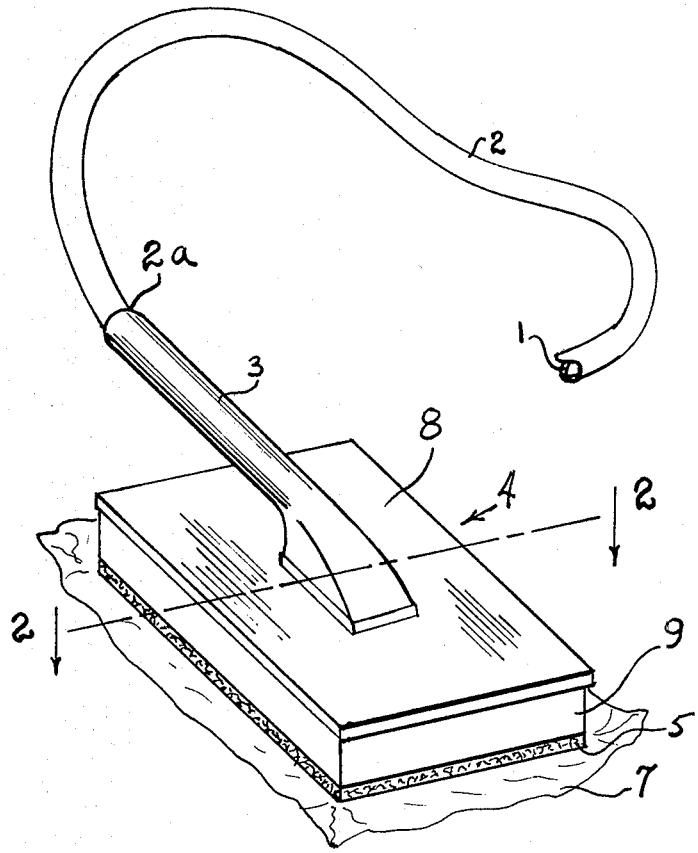
Figure 2:
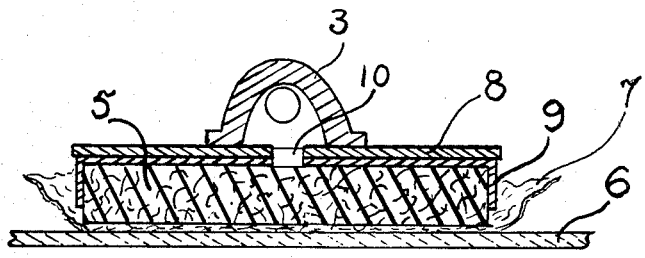
FIG. 2 is a vertical section taken on line 2—2 of FIG. 1.
Figure 3:
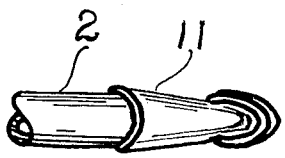
FIG. 3 illustrates a rigid mouthpiece which may be attached to the free end of conduit 2.

Briefly, the device is operated by breathing more or less continuously, and normally, into the mouthpiece end 1 of the flexible tube 2. The moist air passes through the tube and into the hollow handle 3 of the applicator 4, thence into the open pored resilient spongy gas distributing material 5 where it exits against the juxtaposed glass 6 to be cleaned. A disposable piece of tissue or cloth 7 is held loosely on the surface of the spongy material 5 for collecting the loosened soil as the applicator is moved over the surface.

The applicator pad is constructed with a comparatively rigid plate 8, which may be about 3 by 5 inches, which is sealed to the hollow handle 3. A rectangular downwardly open hood member 9 of somewhat more flexible sheet material directs the moist air passing through the open pores of the spongy material 5 into contact with the cool glass surface. An appropriate opening or openings 10 pass through the plate 8 and the hood 9 for the passage of moist air from the hollow handle. These openings should have a combined cross sectional area of at least about one square centimeter to avoid excessive resistance to the breathing process. The flexible tube 2 may be frictionally and removably connected to the hollow handle 3 for convenience, as at 2*a*. In use the open end of the flexible tube 1, which may be about 2 feet long, is held in the mouth with the operator breathing normally into the tube. A rigid mouthpiece 11 may be secured to the free end of conduit 2 if desired. The applicator is held against the cool glass and moved to and fro thereover. Condensed moisture loosens most soil material which is picked up in the disposable tissue 7 which is replaced when it becomes excessively dirty.

It is noted that the device will operate only when the glass or other surface is at a lower temperature than the dew point of human breath and when the soil on the glass is water soluble or dispersible. Because of the limitations of human breathing, the conduit should have an internal diameter of at least $\frac{5}{8}$ inch and the wiping surface not more than about 15 square inches for efficient operation.

Automobile glass is almost always easily cleanable with the device and very conveniently because no cleaning agent is needed. Outside surfaces of windows which are otherwise inaccessible are easily cleaned by reaching over or under the partially opened window with no need to separately apply detergent or other cleaning agent.

What is claimed is:

1. The method of cleaning water removable material from a nonporous surface at a predetermined temperature comprising placing a gas permeable wiping material in surface-to-surface contact with said surface to be cleaned, passing a moisture laden gas through said wiping material into contact with said non-porous surface, said moisture laden gas having a dew point higher than the temperature of said nonporous surface, whereby water from said gas condenses on said nonporous surface, loosening or dissolving said water removable material, while moving said wiping material on said nonporous surface to remove said water removable material therefrom.

2. The method of claim 1 wherein said moisture laden gas is human breath.

3. The method of claim 2 wherein said human breath is directed to said nonporous surface through a flexible conduit and thence to a hooded applicator to said gas permeable wiping material.

4. Apparatus for cleaning water removable material from a nonporous surface comprising an applicator having a resilient, (permeable) open pored, spongy, gas distributing (means) element, said element having a wiping surface for (contact) juxtaposition with said surface to be cleaned, a disposable piece of tissue, loosely held on said wiping surface for interposition between said last mentioned surface and the surface to be cleaned for collecting loosened soil as the applicator is moved over said surface to be cleaned, a hood enveloping said gas distributing (means) element for preventing escape of said gas in directions other than through said wiping surface, a flexible conduit connected to said hood (means) for feeding moisture-laden gas to said hood and thence through said gas distributing (means) element to said wiping surface, said conduit having an internal diameter of at least about $\frac{5}{8}$ inch and said wiping surface havine an area of not more than 15 square inches, whereby human breath can effectively constitute said moisture laden gas.

5. The apparatus of claim 4 wherin a rigid mouthpiece is attached to the free end of said flexible conduit.

* * * * *